US007612493B2

(12) United States Patent
Hwang

(10) Patent No.: US 7,612,493 B2
(45) Date of Patent: Nov. 3, 2009

(54) ELECTRON EMISSION DEVICE WITH IMPROVED FOCUSING OF ELECTRON BEAMS

(75) Inventor: Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 389 days.

(21) Appl. No.: 11/118,305

(22) Filed: Apr. 28, 2005

(65) Prior Publication Data

US 2005/0242707 A1 Nov. 3, 2005

(30) Foreign Application Priority Data

Apr. 29, 2004 (KR) ..... 10-2004-0029891

(51) Int. Cl.
*H01J 1/46* (2006.01)

(52) U.S. Cl. ..... 313/497; 313/495; 313/306; 313/309; 313/310

(58) Field of Classification Search ..... 313/414, 313/447, 446, 463, 537, 540, 485, 495–497, 313/243, 246, 250, 306, 308–310, 293–304
See application file for complete search history.

(56) References Cited

U.S. PATENT DOCUMENTS 6,062,931 A 5/2000 Chuang et al.
6,097,138 A 8/2000 Nakamoto
6,338,662 B1 * 1/2002 Spindt et al. ..... 445/24
6,650,043 B1 * 11/2003 Derraa ..... 313/497
2003/0128647 A1 * 7/2003 Birecki et al. ..... 369/101
2004/0004429 A1 * 1/2004 Oh et al. ..... 313/495
2004/0145305 A1 * 7/2004 Tsujimura ..... 313/506
2004/0232823 A1 * 11/2004 Nakata et al. ..... 313/495

* cited by examiner

*Primary Examiner*—Joseph L Williams
*Assistant Examiner*—Fatima N Farokhrooz
(74) *Attorney, Agent, or Firm*—Christie, Parker & Hale, LLP

(57) ABSTRACT

An electron emission device for focusing the electrons emitted from electron emission regions and uniformly controlling the pixel emission characteristic. The electron emission device includes first and second substrates facing each other, and cathode electrodes having first electrode portions formed on the first substrate along one side thereof, and second electrode portions spaced apart from the first electrode portions at a predetermined distance. Electron emission regions are formed on the second electrode portions. Focusing electrodes fill the gap between the first and the second electrode portions while being extended toward the second substrate with a thickness greater than the thickness of the electron emission regions. Gate electrodes are formed on the cathode electrodes by interposing an insulating layer with openings exposing the electron emission regions.

20 Claims, 7 Drawing Sheets

ELECTRON EMISSION DEVICE WITH IMPROVED FOCUSING OF ELECTRON BEAMS

CROSS REFERENCE TO RELATED APPLICATION

This application claims priority to and the benefit of Korean Patent Application No. 10-2004-0029891 filed on Apr. 29, 2004 in the Korean Intellectual Property Office, the entire content of which is incorporated herein by reference.

BACKGROUND OF THE INVENTION

1. Field of the Invention

The present invention relates to an electron emission device, and in particular, to an electron emission device having electrodes which provide electron emission from electron emission regions with enhanced equipotential patterns.

2. Description of Related Art

Among the known types of the electron emission devices having cold cathodes as the electron emission sources are the field emitter array (FEA) type, the surface conduction emitter (SCE) type, and the metal-insulator-metal (MIM) type.

The FEA type is based on the principle that when a material with a lower work function or a higher aspect ratio is used to form the electron emission source, electrons are easily emitted therefrom by the application of an electric field under a vacuum atmosphere.

A tapered tip structure based on with molybdenum (Mo) or silicon (Si), can be used in forming the electron emission source. With the tip structure, it has an advantage of making it easy to emit electrons therefrom, since the electric field is focused on the sharp front end thereof. However, such a structure is made through a semiconductor process such that the relevant processing steps are complicated, and as the device becomes large, it is difficult to make the device have uniform quality.

On the other hand, carbon-based material, such as carbon nanotube, graphite and diamond-like carbon can be used in forming the electron emission source. In this regard, efforts have been recently made to replace the tip structure with a carbon-based material. Particularly, the carbon nanotube is expected to be an ideal electron emission material since it involves an extremely small end curvature radius of 100 angstroms, and emits electrons well even under a low electric field of 1-10V/μm. With regard to the electron emission device using the carbon nanotube, U.S. Pat. Nos. 6,062,931 and 6,097,138 disclose a cold cathode field emission display.

The FEA type electron emission display may be formed with a triode structure having cathode, gate and anode electrodes. Cathode electrodes, an insulating layer and gate electrodes are sequentially formed on a first substrate, and openings are formed at the gate electrodes and the insulating layer, followed by forming electron emission regions on the portions of the cathode electrodes exposed through the openings. An anode electrode and phosphor layers are formed on the second substrate.

With the above FEA structure, when predetermined driving voltages are applied to the cathode and the gate electrodes, and a positive (+) voltage of several hundreds to several thousands volts is applied to the anode electrode, electric fields are formed around the electron emission regions due to the potential difference between the cathode and the gate electrodes so that electrons are emitted from the electron emission regions. The emitted electrons are attracted by the higher voltage applied to the anode electrode, and collide against the relevant phosphors, thereby exciting them.

However, with the above-structured FEA electron emission device, without any electrode for focusing the electron beams around the electron emission region, the electrons emitted from the electron emission region are diffused at an inclination when they proceed toward the second substrate. Accordingly, the electrons emitted from the electron emission region at the specific pixel do not land on the correct phosphor but strike the neighboring incorrect phosphors. Such a deviation from the designated path causes deterioration in the color purity of the screen and the readability.

Further, with the above-described FEA structure, the emission characteristic of the electron emission regions per the respective pixels is not uniform so that the inter-pixel brightness characteristic becomes uneven. The non-uniformity in the emission characteristic may be due to various factors. Among them, on the one hand, the patterning precision of the electron emission regions is not excellent so that the electron emission regions are differentiated in shape per the respective pixels, and on the other, the device is of large-size so that a voltage drop is made due the internal resistance of the electrodes.

Given this situation, it has been proposed that a focusing electrode should be formed on the gate electrode, and a resistance layer located between the cathode electrode and the electron emission region, thereby achieving the focusing of the electron beams and the uniformity of the emission characteristic per the respective pixels. However, as the above structure is provided with the resistance layer and the focusing electrode in a separate manner, the relevant processing steps become complicated and increase production cost. In particular, when the focusing electrode is formed on the gate electrode, openings for exposing the electron emission regions need to be formed at the focusing electrode, and these openings necessitate complicated processing steps which make it difficult to form the electron emission regions.

SUMMARY OF THE INVENTION

In accordance with the present invention an electron emission device is provided which focuses electron beams, while at the same time uniformly controls the pixel emission characteristic.

In one embodiment, the electron emission device includes first and second substrates facing each other, and cathode electrodes having first electrode portions formed on the first substrate along one side thereof, and second electrode portions spaced apart from the first electrode portions at a predetermined distance. Electron emission regions are formed on the second electrode portions. Focusing electrodes fill the gap between the first and the second electrode portions while being extended toward the second substrate, the focusing electrodes having a thickness greater than the thickness of the electron emission regions. Gate electrodes are formed on the cathode electrodes by interposing an insulating layer with openings exposing the electron emission regions.

The second electrode portions may be externally surrounded by the first electrode portions. The gate electrodes are stripe-patterned in the direction perpendicular to the cathode electrodes.

One or more of the second electrode portions are formed at the respective crossed regions of the cathode and the gate electrodes. When the second electrode portions are formed at the respective crossed regions, at least one of the electron emission regions may be formed on the respective second electrode portions. When a plurality of the second electrode portions are formed at the respective crossed regions, one of the electron emission regions may be formed on the respective second electrode portions.

A pair of the focusing electrodes may face each other above and along a side of the electron emission region parallel to the cathode electrodes. The focusing electrodes are preferably stripe-patterned in the longitudinal direction of the cathode electrodes.

The focusing electrodes have a resistivity of 10-10,000,000 Ω cm.

The focusing electrode within the opening may be partially exposed to the outside of the insulating layer. Specifically, the entire lateral side of the focusing electrode directed toward the electron emission region and the entire top surface of the focusing electrode directed toward the gate electrode may be exposed to the outside of the insulating layer.

The focusing electrode may have a thickness being larger than the thickness of the electron emission region by 1.5 to 5 times, or larger than the shortest distance between the electron emission region and the focusing electrode by 1.5 to 3 times.

The focusing electrode may be surrounded by a protective layer.

DETAILED DESCRIPTION

Figure 1:
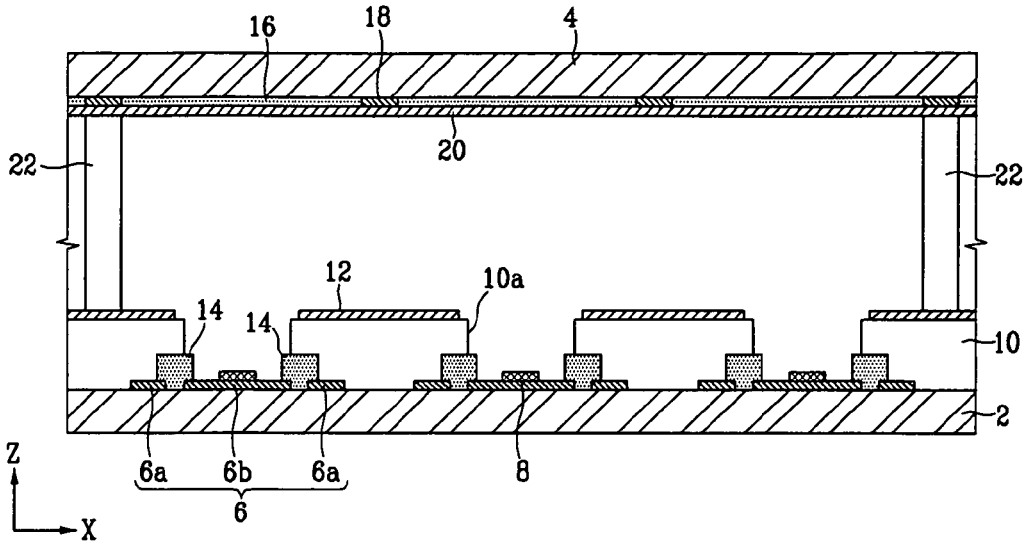
FIG. 1 is a partial sectional view of an electron emission device according to a first embodiment of the present invention.
Figure 2:
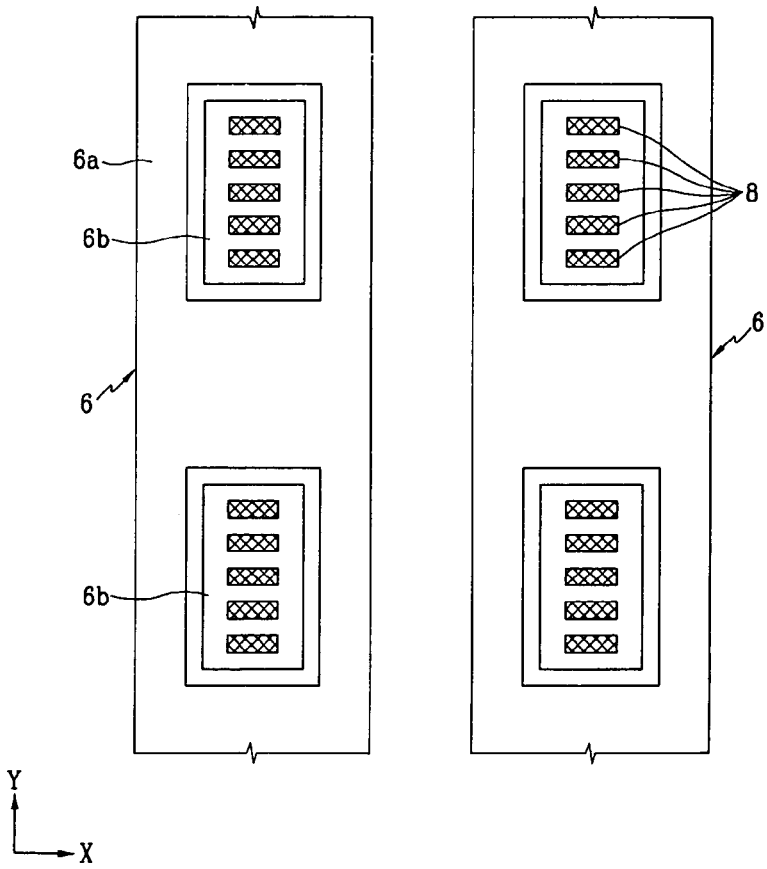
FIG. 2 is a partial plan view of the electron emission device according to the first embodiment of the present invention, partially illustrating cathode electrodes and electron emission regions.
Figure 3:
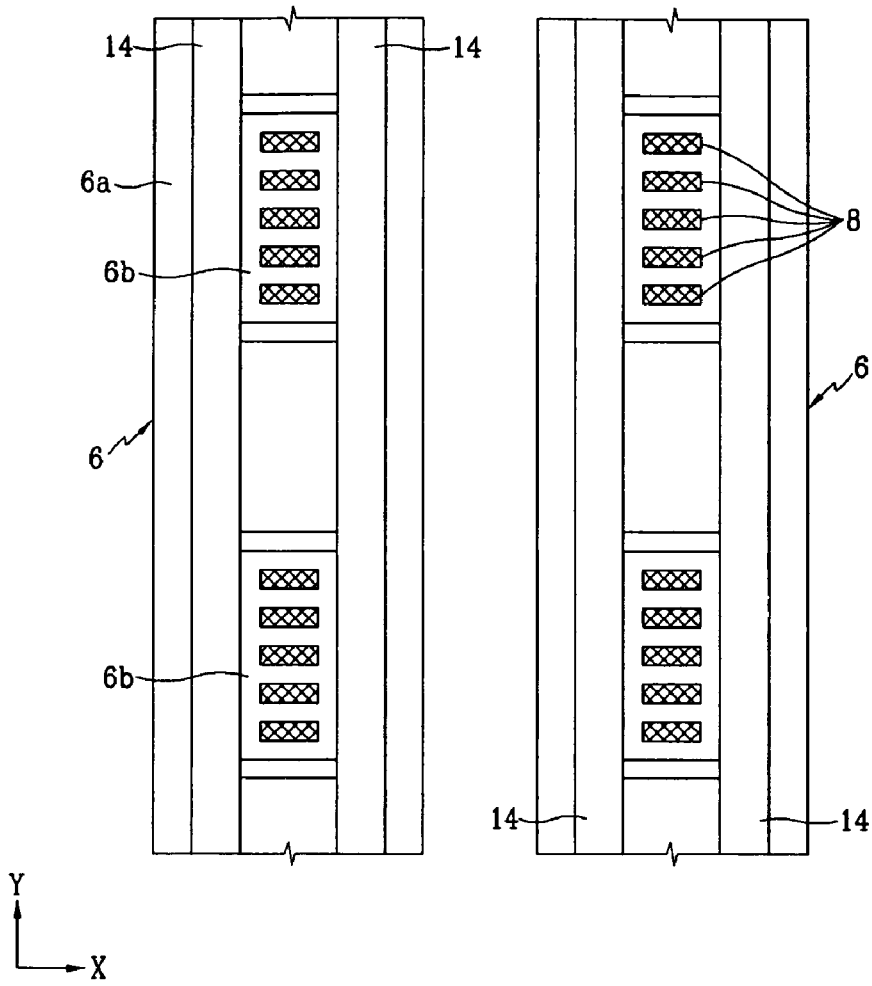
FIG. 3 is a partial plan view of the electron emission device according to the first embodiment of the present invention, partially illustrating cathode electrodes, electron emission regions and focusing electrodes.
Figure 4:
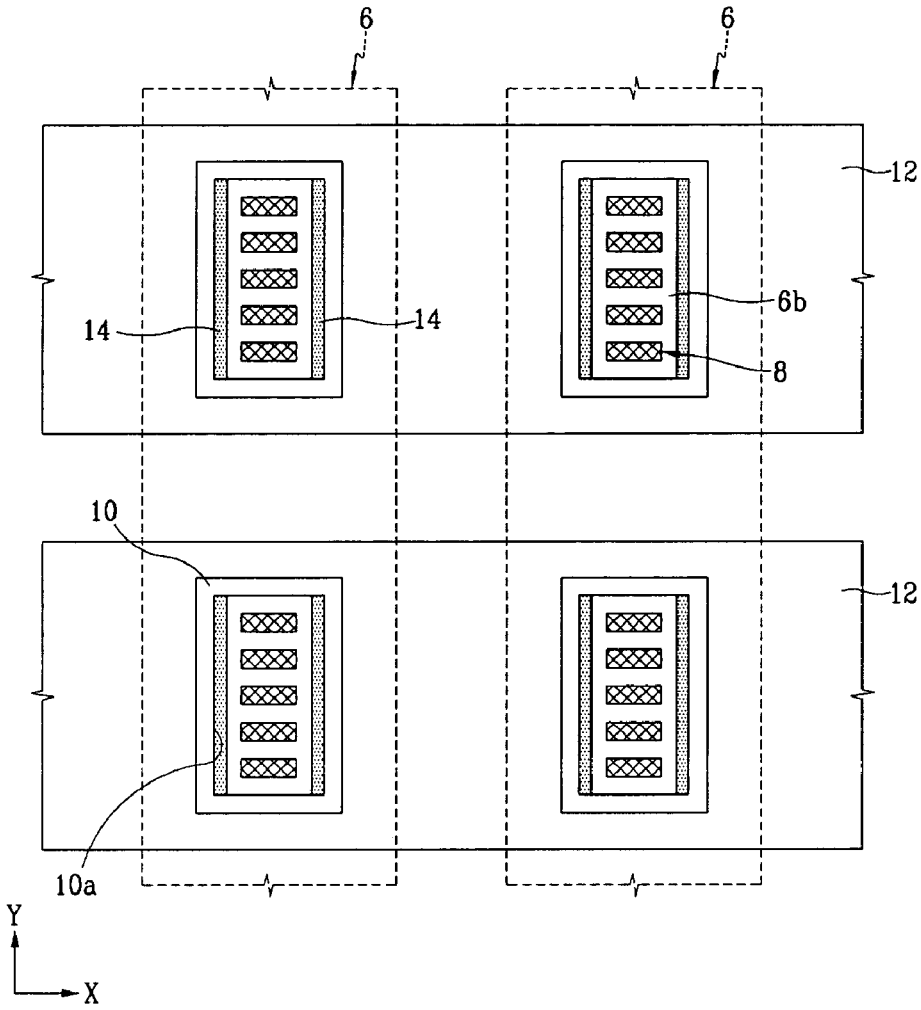
FIG. 4 is a partial plan view of the first substrate shown in FIG. 1.

Referring to FIGS. 1-4, the electron emission device includes first and second substrates 2, 4 spaced apart from each other at a predetermined distance while proceeding substantially parallel to each other. An electron emission structure is formed at the first substrate 2, and an image display structure is formed at the second substrate 4 to emit visible rays resulting from the electron emission such that desired images are displayed.

Specifically, cathode electrodes 6 are stripe-patterned on the first substrate 2 along the one side thereof (in the direction of the Y axis of the drawings), and electron emission regions 8 are formed on the cathode electrodes 6. An insulating layer 10 covers the cathode electrodes 6 with openings 10*a* exposing the electron emission regions 8. Gate electrodes 12 are stripe-patterned on the insulating layer 10 in the direction perpendicular to the cathode electrodes 6 (in the direction of the X axis of the drawing).

In this embodiment, when crossed regions of a cathode 6 and a gate electrode 12 are defined as the pixel regions, an opening 10*a* is formed at each pixel region.

The respective cathode electrodes 6 have a stripe-patterned first electrode portion 6*a*, and an island-shaped second electrode portion 6*b* externally surrounded by the first electrode portion 6*a* while being spaced apart from the first electrode portion 6*a*. In this embodiment, the second electrode portions 6*b* are provided at the respective pixel regions one by one, and at least one electron emission region 8 is formed on each second electrode portion 6*b*.

In this embodiment, the second electrode portion 6*b* is rectangular shaped, but the shape thereof is not limited thereto, and may be varied with a different pattern. It is illustrated in the drawing that a plurality of electron emission regions 8 are placed on the second electrode portion 6*b*, but it is possible that one electron emission region 8 is provided at each second electrode portion 6*b*.

The electron emission region 8 is formed with a material emitting electrons under the vacuum atmosphere when an electric field is applied thereto, such as a carbon-based material and a nanometer-sized material. Preferably, the electron emission region 8 may be formed with carbon nanotube, graphite, graphite nanofiber, diamond, diamond-like carbon, C60, silicon nanowire, and combinations thereof. The electron emission region 8 may be formed through screen printing, chemical vapor deposition, direct growth, or sputtering.

Focusing electrodes 14 are formed below the gate electrodes 12 each with a thickness greater than that of the electron emission region 8 while filling the gap between the first and the second electrode portions 6*a* and 6*b*.

In one embodiment, a pair of the focusing electrodes 14 face each other above and along the sides of the electron emission region 8 parallel to the cathode electrodes 6 (in the direction of the Y axis of the drawing). The pair of focusing electrodes 14 focus the electrons emitted from the electron emission region 8 to prevent the diffusion thereof in the X axis direction of the drawing.

In an exemplary embodiment the focusing electrodes 14 are stripe-patterned in the longitudinal direction of the first electrode portions 6*a*, and provided at the respective cathode electrodes 6 in pairs. The focusing electrodes 14 fill the gap between the first and the second electrode portions 6*a*, 6*b* positioned at the left side of the electron emission region 8 as well as the gap between the first and the second electrode portions 6*a*, 6*b* positioned at the right side of the electron emission region 8, looking in the Y direction.

Each focusing electrode 14 is partially exposed to the outside of the insulating layer 10. In one embodiment the entire lateral side of the focusing electrode 14 directed toward the electron emission region 8 and a part of the top surface of the focusing electrode 14 directed toward the gate electrode 12 are exposed to the outside of the insulating layer 10. The focusing electrode 14 focuses the route of the electron beams over the electron emission region 8 with the driving of the display device.

In one exemplary embodiment the focusing electrode has a thickness of 5 μm or more. The focusing electrode may be made through screen-printing a silver (Ag) paste, and drying and firing it.

The focusing electrode 14 has a resistivity of 10-10,000,000 Ω cm, and hence, works as a resistance layer interconnecting the first electrode portion 6*a* receiving voltages from the outside, and the second electrode portion 6*b* mounted with the electron emission regions 8. The effect of the focusing electrode 14 as the resistance layer will be explained below in connection with the method of driving the electron emission device.

Phosphor layers 16 and an anode electrode 20 are formed on the surface of the second substrate 4 facing the first substrate 2. The anode electrode 20 receives a positive (+) voltage of several tens to several thousands volts from the outside, and makes the electrons emitted from the first substrate 2 be well accelerated toward the phosphor layers 16.

In this embodiment, the phosphor layers 16 are formed with the colors of red, green and blue, and black layers 18 may be disposed between the neighboring phosphor layers 16 to enhance the contrast. An anode electrode 20 is formed on the phosphor layers 16 and the black layers 18 by depositing a metallic material (for instance, aluminum) thereon. The anode electrode 20 based on the metallic layer also serves to enhance the screen brightness due the metal back effect thereof.

The anode electrode may be formed with a transparent conductive material, such as indium tin oxide (ITO), instead of the metallic material. In this case, an anode electrode (not shown) is first formed on the second substrate 4 with a transparent conductive material, and phosphor layers 16 and black layers 18 are formed thereon. When needed, a metallic layer (such as one based on aluminum) may be formed on the phosphor layers 16 and the black layers 18 to enhance the screen brightness. The anode electrode is formed on the entire surface of the second substrate 4. Alternatively, a plurality of anode electrodes may be patterned on the second substrate 4.

The above-structured first and second substrates 2, 4 are spaced apart from each other with a distance such that the gate and the anode electrodes 12, 20 face each other, and are attached to each other by a sealing material, such as a frit. The inner space between the substrates 2, 4 is exhausted to be under the vacuum atmosphere, thereby forming an electron emission device. A plurality of spacers 22 are arranged at the non-light emission area between the first and the second substrates 2, 4 to maintain the distance between the substrates in a constant manner.

The above-structured electron emission device is driven by applying predetermined voltages to the cathode electrodes 6, the gate electrodes 12 and the anode electrode 20 from the outside. For instance, a positive voltage of several to several tens volts is applied to the gate electrodes 12, and a positive voltage of several hundreds to several thousands volts is applied to the anode electrode 20.

Accordingly, electric fields are formed around the electron emission regions 8 due to the potential difference between the cathode electrodes 6 and the gate electrodes 12, and electrons are emitted from the electron emission regions 8. The emitted electrons are attracted by the higher voltage applied to the anode electrode 20, and collide against the phosphor layers 16 at the relevant pixels, thereby exciting them.

With the electron emission device according to the first embodiment having a pair of focusing electrodes 14 placed around the electron emission region 8 with a thickness greater than that of the electron emission region 8, when the electrons are emitted from the electron emission region 8 toward the second substrate 4, the focusing electrodes vary the distribution of the equipotential lines formed around the electron emission region 8, thereby reducing the diffusion angle of the electron beams.

Figure 5A:
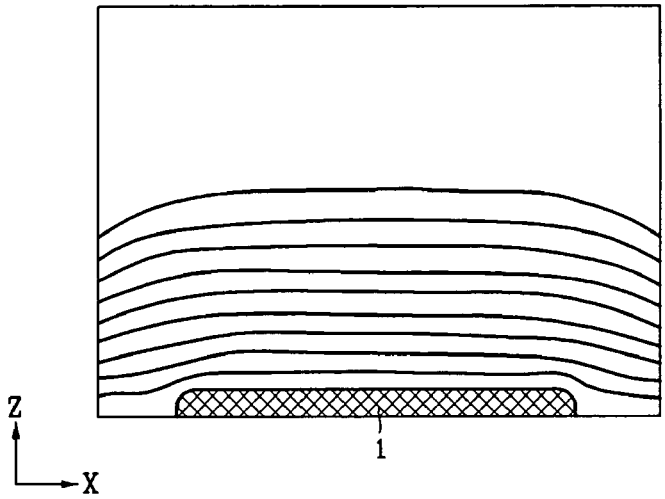
FIG. 5A schematically illustrates equipotential lines formed around electron emission regions with an electron emission device according to a Comparative Example.
Figure 5B:
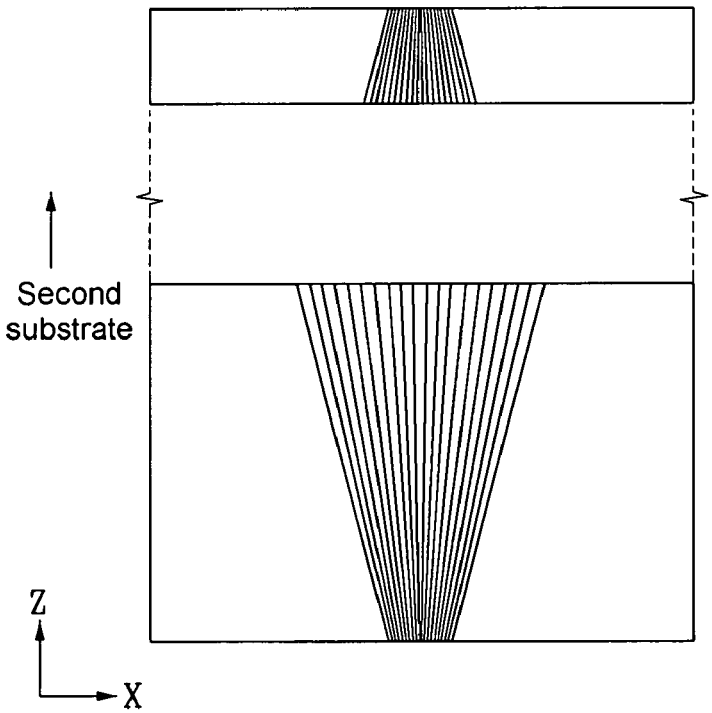
FIG. 5B schematically illustrates the trajectories of electron beams with the electron emission device according to the Comparative Example.

FIG. 5A schematically illustrates the equipotential lines formed around electron emission regions with a conventional electron emission device without focusing electrode. FIG. 5B schematically illustrates the trajectories of electron beams toward the second substrate for such conventional electron emission device. FIGS. 5A and 5B illustrate the measurement result when 0V is applied to the cathode electrodes, 70V to the gate electrodes, and 3 kV to the anode electrode.

Figure 6A:
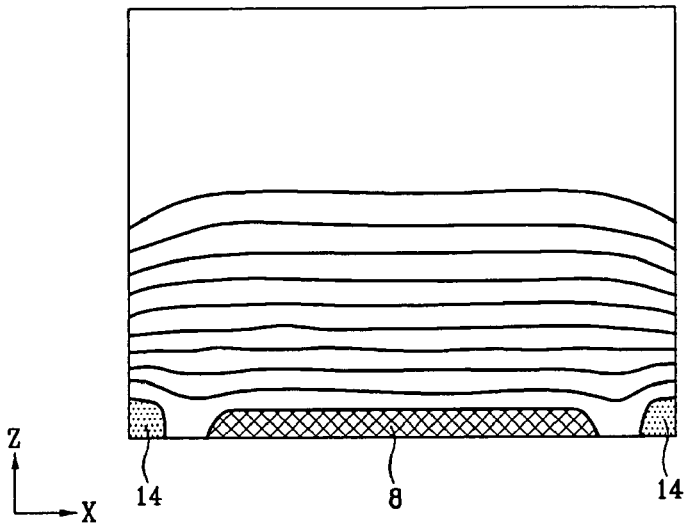
FIG. 6A schematically illustrates equipotential lines formed around the electron emission regions with the electron emission device according to the first embodiment of the present invention.
Figure 6B:
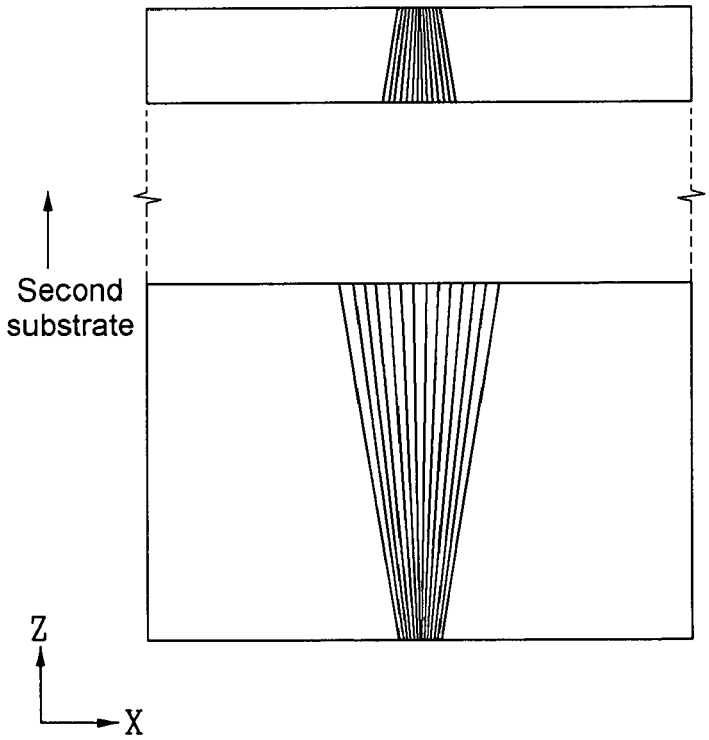
FIG. 6B schematically illustrates the trajectories of electron beams with the electron emission device according to the first embodiment of the present invention.

FIG. 6A schematically illustrates the equipotential lines formed around the electron emission regions with the electron emission device according to the first embodiment. FIG. 6B schematically illustrates the trajectories of the electron beams toward the second substrate with the electron emission device according to the first embodiment. The first embodiment has the same structural components as the conventional electron emission device, but with a focusing electrode added. FIGS. 6A and 6B illustrate the measurement result when the same voltages as with the Comparative Example are applied to the respective electrodes.

First, as shown in FIGS. 5A and 5B, the equipotential lines form curves substantially concaved toward the electron emission region 1. Accordingly, the electrons moving perpendicular to the equipotential lines are diffused toward the second substrate with a large diffusion angle.

In contrast, as shown in FIGS. 6A and 6B, with the electron emission device in accordance with the present invention, at least one equipotential line positioned close to the electron emission region 8 forms a convex portion toward the electron emission region 8 between the electron emission region 8 and the focusing electrode 14, and the electrons emitted from the electron emission region 8 proceed toward the second substrate with a small diffusion angle, due to the convex portion.

Accordingly, with the electron emission device according to the present invention, the electrons emitted from the electron emission region 8 at the specific pixel correctly land on the relevant phosphor layer 16, thereby heightening the color purity and the readability.

Furthermore, the focusing electrode 14 works as a resistance layer interconnecting the first and the second electrode portions 6*a* and 6*b* of the cathode electrode 6. In conventional devices which have a plurality of electron emission sites where electrons are emitted from the electron emission regions at various pixels, the electron emission at the respective electron emission sites is non-uniformly made due to the unevenness of the shape of respective electron emission regions 8 and the internal resistance of the cathode and the gate electrodes 6 and 12.

However, with the present embodiment, the difference in electron emission between the electron emission sites with different discharge currents is reduced to thereby enhance the uniformity of electron emission per the respective pixels.

Figure 7:
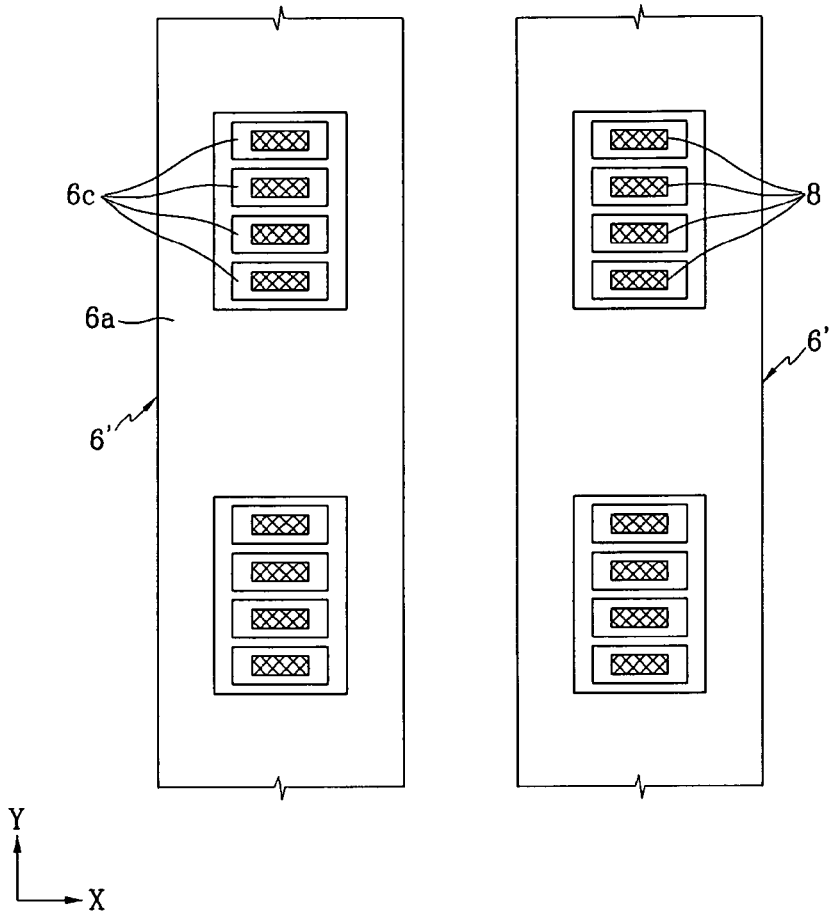
FIG. 7 is a partial plan view of an electron emission device according to a second embodiment of the present invention, partially illustrating cathode electrodes.

FIG. 7 is a partial plan view of an electron emission device according to a second embodiment of the present invention, partially illustrating cathode electrodes thereof. The electron emission device according to the second embodiment has the same structural components as those of the electron emission device related to the first embodiment except that a plurality of second electrode portions 6*c* for the cathode electrodes 6' are provided at the respective pixel regions, and an electron emission region 8 is formed at each second electrode portion 6*c*. The structure according to the first embodiment is advantageous in heightening the uniformity of electron emission per the respective pixels, and the structure according to the second embodiment is advantageous in heightening the uniformity of electron emission per the respective electron emission regions 8.

Figure 8:
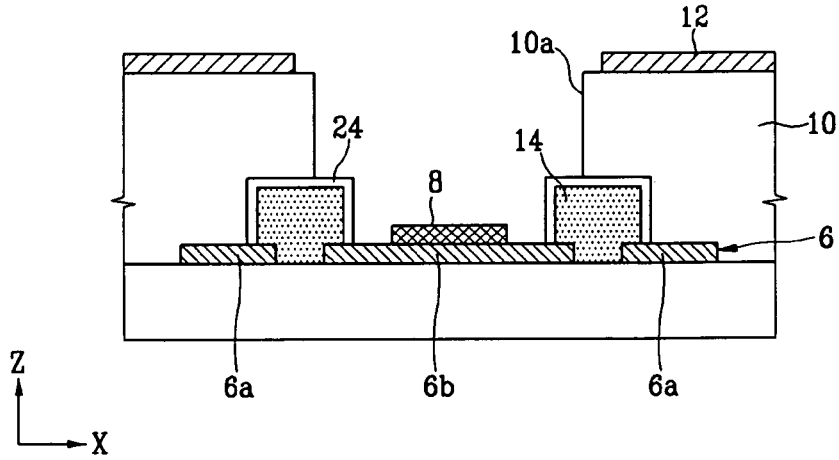
FIG. 8 is a partial amplified sectional view of an electron emission device according to a third embodiment of the present invention.

FIG. 8 is a partial sectional view of an electron emission device according to a third embodiment of the present invention. The electron emission device according to the third embodiment has the same structural components as those of the electron emission device of the first embodiment except that the focusing electrode 14 is surrounded by a protective layer 24.

When the focusing electrodes 14, the insulating layer 10 and the gate electrodes 12 are formed on the cathode electrodes 6, and the gate electrodes 12 and the insulating layer 10 are partially etched using an etchant to form openings 10*a*, the protective layer 24 prevents the focusing electrode 14 from being damaged due to the etchant. The protective layer 24 may be formed with chromium (Cr), and depending upon the kind of the etchant, replaced with a material bearing a lower etching rate with respect to the relevant etchant.

Figure 9:
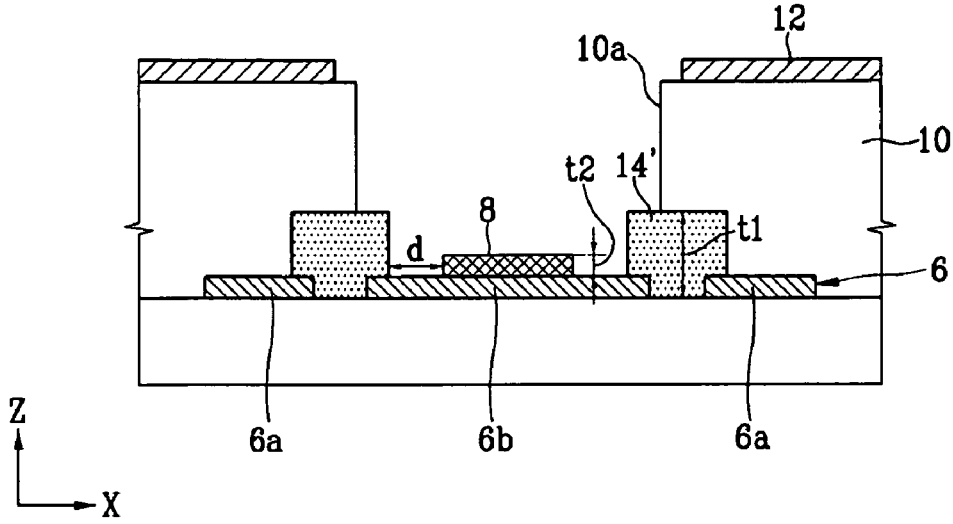
FIG. 9 is a further partial sectional view of the electron emission device shown in FIG. 1.

In the embodiment shown in FIG. 9, the focusing electrode 14' is formed with a thickness t1, which is larger than the thickness t2 of the electron emission region 8 by 1.5 to 5 times. Further, the thickness t1 of the focusing electrode 14' is established to be larger than the shortest distance d between the electron emission region 8 and the focusing electrode 14' by 1.5 to 3 times. When the thickness t1 of the focusing electrode 14' satisfies the above-identified condition, the focusing capacity thereof can be exerted maximally.

As described above, with the electron emission device in accordance with the present invention, the diffusion angle of the electrons emitted from the electron emission region is reduced due to the focusing electrode, and the uniformity of electron emission per the respective pixels is enhanced. Accordingly, the electron emission device provides heightened screen color purity and readability, uniform brightness characteristic per the respective pixels, and enhanced screen quality. Furthermore, as the electron emission device does not involve any separate resistance layer, the structural components and the processing steps thereof can be simplified.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron emission device comprising:

a first substrate and a second substrate facing each other;

cathode electrodes having first electrode portions on the first substrate and second electrode portions spaced apart from the first electrode portions by a gap, the gap being between opposing faces of the first electrode portions and the second electrode portions;

electron emission regions having a thickness in a direction between the first and second substrates and being on the second electrode portions;

focusing electrodes having a thickness in the direction between the first and second substrates, the focusing electrodes filling the gap while being extended toward the second substrate with a focusing electrode thickness greater than an electron emission region thickness; and gate electrodes on the cathode electrodes with an insulating layer between the gate electrodes and cathode electrodes, the gate electrodes having gate openings exposing the electron emission regions.

2. The electron emission device of claim 1, wherein the second electrode portions are externally surrounded by the first electrode portions.

3. The electron emission device of claim 1, wherein a pair of the focusing electrodes face each other above and along a side of the electron emission region parallel to the cathode electrodes.

4. The electron emission device of claim 1, wherein the focusing electrodes have a resistivity of 10-10,000,000Ω cm.

5. The electron emission device of claim 1, wherein the entire lateral side of the focusing electrode directed toward the electron emission region and a part of the top surface of the focusing electrode directed toward the gate electrode are exposed to an outside of an insulating layer insulating the gate electrode from the cathode electrode.

6. The electron emission device of claim 1, wherein the electron emission region and the focusing electrode satisfy the following condition: $1.5(t2) \leqq t1 \leqq 5(t2)$ where t1 indicates the thickness of the focusing electrode, and t2 indicates the thickness of the electron emission region.

7. The electron emission device of claim 1, wherein the electron emission region and the focusing electrode satisfy the following condition: $1.5d \leqq t \leqq 3d$ where t indicates the thickness of the focusing electrode, and d indicates the shortest distance between the electron emission region and the focusing electrode.

8. The electron emission device of claim 1, wherein the focusing electrode is surrounded by a protective layer.

9. The electron emission device of claim 1, wherein the electron emission region is formed with at least one material selected from the group consisting of carbon nanotube, graphite, graphite nanofiber, diamond, diamond-like carbon, C60, and silicon nanowire.

10. The electron emission device of claim 1, further comprising at least one anode electrode formed on the second substrate, and phosphor layers on a surface of the anode electrode.

11. The electron emission device of claim 2, wherein the gate electrodes are stripe-patterned in the direction perpendicular to the cathode electrodes.

12. The electron emission device of claim 11, wherein one or more of the second electrode portions are formed at respective crossed regions of the cathode electrodes and the gate electrodes.

13. The electron emission device of claim 11, wherein the second electrode portions are at respective crossed regions of the cathode electrodes and the gate electrodes, and at least one of the electron emission regions is on the respective second electrode portions.

14. The electron emission device of claim 11, wherein a plurality of the second electrode portions are at respective crossed regions of the cathode and the gate electrodes, and one of the electron emission regions is formed on each of the respective second electrode portions.

15. The electron emission device of claim 3, wherein the focusing electrodes are stripe-patterned in the longitudinal direction of the cathode electrodes.

16. The electron emission device of claim 8, wherein the protective layer is chromium.

17. A method of focusing electrons emitted from electron emission regions in an electron emission device to corresponding light emitting regions, the electron emission regions being on cathode electrodes on a first substrate, the corresponding light emitting regions being on a second substrate separated from the first substrate, the method comprising:

forming gate electrodes over the cathodes electrodes, the gate electrodes being separated from the cathode electrodes by an insulating layer and having gate openings exposing respective electron emission regions at crossings of the gate electrodes and the cathode electrodes;

wherein the cathode electrodes have an internal cathode region within respective gate openings and support at least one electron emission region and are separated from an external cathode region by focusing electrodes parallel to the cathode electrodes, the focusing electrodes filling a gap between opposing faces of the internal cathode region and the external cathode region.

18. The method of claim 17, wherein the focusing electrodes and the electron emission regions each have a thickness in the direction between the first substrate and second electrodes, such that a focusing electrode thickness is greater than an electron emission region thickness.

19. The method of claim 18, wherein respective electron emission regions and focusing electrodes satisfy the following condition: $1.5(t\mathbf{2}) \leqq t\mathbf{1} \leqq 5(t\mathbf{2})$ where t1 indicates the thickness of the focusing electrode, and t2 indicates the thickness of the electron emission region.

20. The method of claim 18, wherein respective electron emission regions and focusing electrodes satisfy the following condition: $1.5d \leqq t \leqq 3d$ where t indicates the thickness of the focusing electrode, and d indicates the shortest distance between a respective electron emission region and focusing electrode.

* * * * *

UNITED STATES PATENT AND TRADEMARK OFFICE

CERTIFICATE OF CORRECTION

PATENT NO. : 7,612,493 B2
APPLICATION NO. : 11/118305
DATED : November 3, 2009
INVENTOR(S) : Seong-Yeon Hwang It is certified that error appears in the above-identified patent and that said Letters Patent is hereby corrected as shown below:

| | |
|---|---|
| Column 8, Claim 2, line 4 | Delete "externally" |
| Column 8, Claim 5, line 12 | Delete "the" and Insert -- an -- |
| Column 8, Claim 9, line 32 | After "is" delete "formed with" and Insert -- of -- |
| Column 8, Claim 10, line 37 | Delete "formed" |
| Column 8, Claim 11, line 41 | Delete "the" and Insert -- a -- |
| Column 8, Claim 12, line 44 | Delete "formed" |
| Column 9, Claim 17, line 1 | Delete "cathodes" and Insert -- cathode -- |
| Column 9, Claim 18, line 15 | After "in" delete "the" and Insert -- a --<br>After "and" Insert -- the -- |
| Column 10, Claim 18, line 1 | Delete "electrodes," and Insert -- substrate -- |

Signed and Sealed this
Twenty-fifth Day of January, 2011

David J. Kappos

David J. Kappos
*Director of the United States Patent and Trademark Office*